United States Patent [19]

Ishizaki et al.

[11] Patent Number: 4,525,392

[45] Date of Patent: Jun. 25, 1985

[54] METHOD OF SIMULTANEOUSLY APPLYING MULTIPLE LAYERS TO WEB

[75] Inventors: Keiichi Ishizaki; Shuzo Fuchigami, both of Kanagawa, Japan

[73] Assignee: Fuji Photo Film Company, Limited, Kanagawa, Japan

[21] Appl. No.: 434,780

[22] Filed: Oct. 18, 1982

Related U.S. Application Data

[63] Continuation of Ser. No. 230,073, Jan. 30, 1981, abandoned.

[30] Foreign Application Priority Data

Jan. 30, 1980 [JP] Japan ..... 55-9527

[51] Int. Cl.[3] ..... B05D 1/30

[52] U.S. Cl. ..... 427/420; 118/410; 118/411; 427/411; 427/294; 430/935

[58] Field of Search ..... 118/410, 324, 411; 427/420, 348, 445, 294; 430/935

[56] References Cited

U.S. PATENT DOCUMENTS 4,113,903 9/1983 Choinski ..... 427/348

*Primary Examiner*—Sam Silverberg

*Attorney, Agent, or Firm*—Sughrue, Mion, Zinn, Macpeak, and Seas

[57] ABSTRACT

A method of simultaneously applying multiple layers of coating liquids to a moving web with a slide hopper type coating apparatus in which the fluidity of a coating liquid for forming the lowermost of multiple layers is improved to thereby eliminate inter-layer mixing and waving. The first coating liquid which forms the lowermost of the multiple layers is prepared so that it, when run at a low shear rate, has a viscosity equal to or different by no more than ±10 cp from a viscosity of a second coating liquid for forming a layer next to the lowermost layer when the second coating liquid flows at a low shear rate and that the first coating liquid, when run at a high shear rate, has a viscosity lower than the viscosity of the second coating liquid when the second coating liquid flows at a high shear rate. The first and second liquids are then applied to a moving web with the slide hopper type coating apparatus.

4 Claims, 2 Drawing Figures

METHOD OF SIMULTANEOUSLY APPLYING MULTIPLE LAYERS TO WEB

This is a Continuation of application Ser. No. 230,073, filed Jan. 30, 1981 (now abandoned).

BACKGROUND OF THE INVENTION

The present invention relates to methods of coating a supporting material with a liquid-state coating compound (hereinafter referred to as "a coating liquid" when applicable). More particularly, the invention relates to a method of simultaneously applying the multiple layers of coating liquids on a moving flexible belt-shaped material (hereinafter referred to as "a web" when applicable).

A coating method of this general type is well known in the art and is described in Japanese Laid-Open Patent Application No. 115214/1977. The specific feature of the conventional coating method resides in that the web is run at least at a speed of 100 cm/sec, the lowermost layer is thin and is formed by a coating compound of low viscosity, a layer immediately above the lowermost layer is thicker than the lowermost layer and is formed by a coating compound of high viscosity, and the thickness and viscosities of the lowermost layer and the layer immediately above the lowermost layer are selected so that the eddy movement of the coating bead is limited in the two layers. With this arrangement, while inter-layer mixing occurs between the two layers, the remaining layers are formed individually without mixing during the coating process. The viscosity and the covering power of the coating liquid forming the lowermost layer are made lower than those of the layer next to the lowermost layer to decrease the load required for fully drying the layers thereby increasing the coating speed.

However, the conventional coating method is disadvantageous in that, as the viscosity of the coating liquid forming the lowermost layer is low, the bead region is liable to become unstable and, accordingly, the ability to withstand high speed coating is very small.

On the other hand, in U.S. Pat. No. 4,113,903 there is proposed a coating method in which double-layer liquid coating is employed which includes the application of the shearing thinning carrier layer of a pseudoplastic liquid as a layer next to the web with the pseudoplastic liquid having a viscosity of from 20 cp to 200 cp at a shear rate of 100 $sec^{-1}$ and a viscosity lower than 10 cp at a shear rate of 100,000 $sec^{-1}$. That is, the conventional coating method uses a pseudoplatic liquid which has a high viscosity at low shearing rates and a low viscosity at high shearing rates to eliminate the above-described instability of the bead region.

However, the conventional method is still disadvantageous in the following points. Even with the physical properties described above maintained only for the coating liquid for forming the lowermost layer, the coating liquids forming the lowermost layer and the next layer become ill-balanced in the physical property of fluidity. As a result a so-called "interlayer mixing and waving" phenomena occur as the coating liquids flow down the slide surface of a slide hopper type coating apparatus. Accordingly, it is difficult to produce webs of satisfactory quality.

SUMMARY OF THE INVENTION

Accordingly, an object of the invention is to eliminate all of the above-described difficulties accompanying a conventional coating method. More specifically, an object of the invention is to provide a novel method of simultaneously applying the multiple layers of coating liquids to a moving web by using a slide hopper type coating liquid in which the fluidity of a coating liquid for forming the lowermost of the multiple layers is improved to thereby eliminate the phenomenon of interlayer mixing and waving occurring when coating liquids flow down in a conventional coating method and thereby to produce coated webs of satisfactory quality and in which the bead region is strengthened to make it possible to coat the web at high speed.

The foregoing object and other objects of the invention have been achieved by the provision of a method of simultaneously applying multiple layers of coating liquids to a moving web using a slide hopper type coating apparatus in which, according to the invention, before being supplied to the coating apparatus, a first coating liquid for forming the lowermost of the multiple layers is so prepared that the first coating liquid, when run at a low shearing rate, has a viscosity equal to or different by no more than $\pm 10$ cp from the viscosity of a second coating liquid for forming a layer next to the lowermost layer which is provided when the second coating liquid flows at a low shear rate. The first coating liquid, when run at a high shear rate, has a viscosity lower than a viscosity of the second coating liquid which is provided when the second coating liquid flows at a high shear rate.

DESCRIPTION OF THE PREFERRED EMBODIMENTS

The invention will be described with reference to preferred embodiments thereof.

Figure 1:
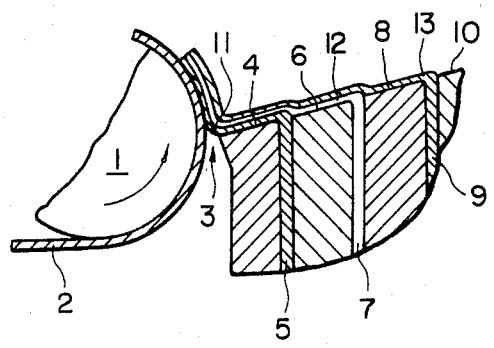
FIG. 1 is a sectional side view showing a slide hopper type coating apparatus for coating a web with three layers simultaneously, according to a preferred embodiment of the invention.
Figure 2:
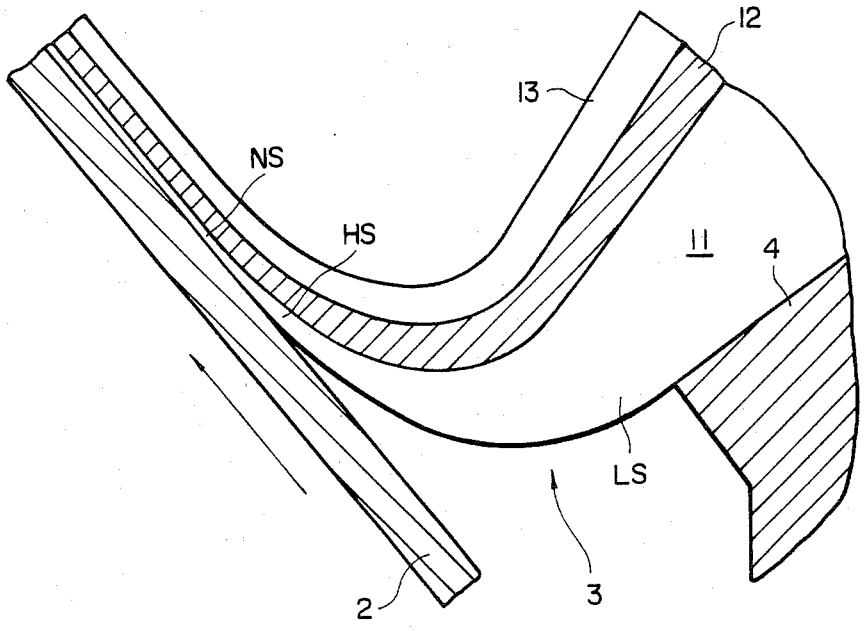
FIG. 2 is an enlarged sectional view showing a multilayer bead formed with the coating apparatus of FIG. 1.

FIG. 1 is a sectional side view showing a slide hopper type coating apparatus for coating a web with three layers simultaneously according to a preferred embodiment of the invention. FIG. 2 is an enlarged view showing essential parts of the coating apparatus of FIG. 1.

In FIGS. 1 and 2, reference numeral 1 designates a backing roll; 2 a web; 3 a bead region; 4, 6, 8 and 10 slide surfaces; 5, 7 and 9 slots; 11 a coating liquid for forming the lowermost or first layer; 12 a coating liquid for forming the middle or second layer; and 13 a coating liquid for forming the uppermost or third layer. The web 2 is continuously conveyed on the outer wall of the backing roll 1 in the direction of the arrow by means of a conveying device (not shown).

The coating liquid 11 for forming the lowermost layer is supplied into the slot 5 by a conventional device (not shown). The coating liquid 11 flows through the slot 5 to the slide surface 4 and then down the slide surface 4 by the force of gravity. Similarly, the other coating liquids 12 and 13 for forming the second layer and the third layer flow through the slots 7 and 9 to the slide surfaces 6 and 8 and then down the slide surfaces 6 and 8, respectively.

As the coating liquids 11, 12 and 13 arrive at the web 2, their directions of movement are changed at the bead region as shown in FIG. 2, i.e. the coating liquids are pulled upwardly by the web 2 on the backing roll 1 and are gradually formed into thin layers on the web.

The distribution of the shearing velocities of the coating liquid is as follows. In the case of the coating liquid 11 for forming the lowermost layer, as shown in FIG. 2, the coating liquid 11 begins flowing down the slide surface 4 at a low shear rate. However, as the coating liquid 11 flows down the slide surface 4, the shear rate is gradually increased, and finally at the bead region the coating liquid 11 has a high shear rate. If, as shown in FIG. 2, a high shear rate typical point is at HS, a low shear rate typical point is at LS, and a shear rate 0 $sec^{-1}$ is at NS, then the lowermost layer forming coating liquid 11 has the highest shear at the point HS where it is pulled maximally. In general, the low shear rate ranges from several tens to several hundreds of $sec^{-1}$ and the high shear rate ranges from several thousands to several hundred-thousands of $sec^{-1}$. These values depend on the properties of a coating liquid and on coating conditions such as the angle of the slide surface and flow rate.

In the coating method according to the invention, the lowermost layer forming coating liquid 11 is a non-Newtonian liquid. The liquid 11, after being prepared with respect to the liquid properties of the second layer forming liquid 12 in the manner described below, is supplied to the slot 5 of the coating apparatus. In other words, the coating liquid 11 is prepared in advance so that, while the coating liquid 11 flows down the slide surface 4 at the low shear rate, the viscosity of the coating liquid 11 is equal to or different by no more than ±10 cp from that of the second layer forming coating liquid 12 running simultaneously, and while the coating liquid 11 flows in the bead region 3 at the high shear rate, the viscosity of the coating liquid 11 is lower than that of the second layer forming coating liquid 12 provided when the liquid 12 flows at the high shear rate.

More specifically, the preparation of the lowermost layer forming coating liquid 11 can be achieved as follows. First, the properties of the second layer forming coating liquid 12 are determined. Based on the properties of the coating liquid 12 thus determined, the density of the lowermost layer forming coating liquid 11 is decreased to a predetermined value. Then, a viscosity-increasing agent or the like is added to the coating liquid 11 thus treated to determine the properties of the coating liquid 11. In general, the mutual relationship between these liquid properties is determined through experiments. For instance in coating a web with three layers simultaneously, a liquid preparation is so made that, where the viscosity of the second layer forming coating liquid at the low shear rate is 38.3 cp (at 40° C.) and the viscosity of the second layer forming coating liquid at the high shear rate is 17.8 cp, the lowermost layer forming coating liquid has a viscosity of 37.5 cp at the low shear rate and a viscosity of 13.6 cp at the high shear rate. The properties of the third layer forming coating liquid 13 is not directly related to those of the lowermost layer forming coating liquid 11 and therefore can be determined in correlation with those of the second layer forming coating liquid 12 only.

The viscosity of the lowermost layer forming coating liquid 11 is made equal to or different by no more than ±10 cp from that of the second layer forming coating liquid 11 when they flow at the low shear rate. That is, the balance of viscosity is maintained between the two liquids as described above. Therefore, when the two liquids flow down the slide surface 4 under the force of gravity, the velocity distribution in the flow is smooth, and accordingly so-called inter-layer mixing and waving are prevented.

Furthermore, the non-Newtonian coating liquid for forming the lowermost layer is lowest in viscosity at the typical point HS where the highest shear rate occurs and thus its bead region 3 is strengthened. Thus, the ability to withstand high speed coating is increased.

While the invention has been described with reference to preferred embodiments, it should be noted that the invention is not limited thereto or thereby. For instance, the embodiment described above may be modified as follows. In the above-described embodiment, the above-described physical properties are imparted to the lowermost layer forming coating liquid. However, the above-described physical properties may be imparted to a liquid which can be readiy coated over the web 2 with a carrier layer of this liquid being inserted between the web 2 and the lowermost layer.

In this case, the web coating characteristic of the multi-layer liquid is not affected by the coating liquids forming layers above the lowermost layer at all but depends only on the coating characteristic of the lowermost layer forming coating liquid. Therefore, the coating speed can be remarkably increased.

As is apparent from the above description, the invention has the following effects and merits:

(1) A non-Newtonian liquid is employed as the lowermost layer forming coating liqid. The viscosity of the lowermost layer forming coating liquid at the low shear rate is made equal to or different by no more than ±10 cp from that of the second layer forming coating liquid at the low shear rate. Accordingly, when the two coating liquids flow down the slide surface, no inter-layer mixing and waving occurs. Thus, the resultant coated film is of excellent quality.

(2) Furthermore, the lowermost layer forming coating liquid has a low viscosity when it flows at the high shear rate. Therefore, the bead region is strengthened which thereby permits high speed coating.

(3) The physical properties according to the invention are imparted to a liquid which has a considerably excellent web coating characteristic to form a carrier layer which is inserted between the web and the lowermost of the layers in the conventional structure. Therefore, the multi-layer forming coating liquids have excellent web coating characteristics. The insertion of the carrier layer protects a plurality of coating liquids which form layers above the lowermost layer from physically adverse influences. Thus, the coating speed is remarkably increased compared with the conventional layer structure.

In order to clarify the effects of the invention, a spefific example of the coating method according to the invention wil be described.

EXAMPLE

A comparison experiment of the coating method according to the invention and the conventional coating method was carried out with a hopper type coating apparatus as shown in FIG. 1 in which the web was of a triacetate-cellulose (TAC) base 18 cm in width.

Layer Structure in Conventional Method

First layer: A silver halogenide gelatin emulsion for X-rays having a viscosity of 35.2 cp at 40° C. was applied at a flow rate 40 $cm^3$/cm min.

Second layer: An aqueous gelatin solution containing a surface active agent having a viscosity of 13.5 cp at 40°C. was applied at a flow rate 13.3 $cm^3$/cm min.

Layer Structure of Invention

Lowermost layer: An aqueous gelatin solution having a viscosity of 40.0 cp at a shear rate of 10 $sec^{-1}$ at 40° C. and a viscosity of 13.6 cp at a shear rate of 5000 $sec^{-1}$ was applied at a flow rate of from 5 $cm^3$/cm min to 30 $cm^3$/cm min. Specifically, the liquid composition of the lowermost layer is as follows:

| | |
|---|---|
| Water | 1000 wt. part |
| Lime-treated gelatin | 50 wt. part |
| Potassium polystyrenesulfonate (as a viscosity increasing agent) | 0.125 wt. part |
| Sodium Di-n-octylsulfosuccinate (as a surfactant) | 0.100 wt. part |

First layer: Similar to the first layer in the layer structure of the conventional method.

Second layer: Similar to the second layer in the layer structure of the conventional method.

The highest coating speed attainable with the conventional coating method was 208 m/min. On the other hand, with the coating method according to the invention, even when the flow rate for the lowermost layer was decreased to 5 $cm^3$/cm min, no inter-layer mixing and waving were occurred. That is, the resultant coating quality was excellent, and yet the coating speed could be increased to 262 m/min.

What is claimed is:

1. A method of simultaneously applying multiple layers of coating liquids to a moving web with a slide hopper type coating apparatus comprising the steps of: preparing a first coating liquid for forming the lowermost of said multiple layers so that said first coating liquid, when run at a low shear rate, has a viscosity equal to or different by no more than ±10 cp from a viscosity of a second coating liquid for forming a layer next to said lowermost layer when said second coating liquid flows at a low shear rate, and that said first coating liquid, when run at a high shear rate has a viscosity lower than a viscosity of said second coating liquid when said second coating liquid flows at a high shear rate; and applying said first and second liquids to said moving web with said slide hopper type coating apparatus.

2. The method of claim 1 wherein said first coating liquid is non-Newtonian.

3. The method of claim 1 wherein said step of preparing said first coating liquid comprises adding a viscosity-varying agent to said first coating liquid.

4. A method of simultaneously applying multiple layers of coating liquids to a moving web with a slide hopper coating apparatus comprising the steps of: preparing a first coating liquid for forming a carrier layer for multiple layers wherein said first coating liquid, when run at a low shear rate, has a viscosity equal to or different by no more than ±10 cp from a viscosity of a second coating liquid for forming a layer next to said lowermost carrier layer when said second coating liquid flows at a low shear rate, and that said first coating liquid, when run at a high shear rate, has a viscosity lower than a viscosity of said second coating liquid when said second coating liquid flows at a high shear rate; and applying said first and second liquids together with a third coating liquid to said moving web with said slide hopper type coating apparatus.

* * * * *